US005142738A

United States Patent [19]

Ojima

[11] Patent Number: 5,142,738

[45] Date of Patent: Sep. 1, 1992

[54] HINGE DEVICE

[75] Inventor: Juji Ojima, Aikawa, Japan

[73] Assignee: NHK Spring Co., Ltd., Yokohama, Japan

[21] Appl. No.: 735,051

[22] Filed: Jul. 24, 1991

[30] Foreign Application Priority Data

Jul. 24, 1990 [JP] Japan ..... 2-195185

[51] Int. Cl.[5] ..... E05F 5/08

[52] U.S. Cl. ..... 16/306; 16/85; 16/342

[58] Field of Search ..... 16/306, 54, 52, 85, 16/342

[56] References Cited

U.S. PATENT DOCUMENTS 4,574,423 3/1986 Ito et al. ..... 16/85

FOREIGN PATENT DOCUMENTS 62-81739 5/1987 Japan .

1040102 9/1983 U.S.S.R. ..... 16/85

*Primary Examiner*—Robert L. Spruill

*Assistant Examiner*—Carmine Cuda

*Attorney, Agent, or Firm*—Fleit, Jacobson, Cohn, Price, Holman & Stern

[57] ABSTRACT

A hinge device to be used between a rotatable component and a stationary component to work as a pivoting device and to permit a restrained rotation of one component in relation to the other due to a high viscosity grease and the torsional force of a coil spring inserted therein in a predetermined angular range; and subsequently to restrain the rotating speed by means of the high viscosity grease and the coil spring.

4 Claims, 5 Drawing Sheets

HINGE DEVICE

FIELD OF THE INVENTION

The present invention relates to a hinge device having a pivot portion between a rotatable component and a stationary component, more particularly to a hinge device having an internal spring for absorbing a drop impact of the rotatable component.

BACKGROUND OF THE INVENTION

A hinge device absorbing a drop impact of rotatable components such as a sound board of a piano and lid of a record player, lap top computer, copier, various office equipment or a stool was disclosed by a Japanese Utility Model Application Laid-open No. 62-81739.

As shown in FIG. 12, a hinge of the prior art comprises a case 41 to be fastened on a stationary component such as a stool, a rotatable component 42 to be connected to a lid thereof, a high viscosity grease filled in a gap between the case 41 and the rotatable component 42, and a coil spring 43 mounted between the bottom of the case 41 and the rotatable component 42.

However, in this conventional hinge device, the rotatable component 42 and a shaft 44 to be connected to a stool lid are integrally constructed. Therefore, the case 41 must be fastened to a stool after connecting the shaft 44 to the stool lid which causes poor assembly. Besides, it is impossible to manufacture the case 41 integrally with a stool.

Also, since a pair of "O" rings 45 and 46 are inserted into ring grooves, the rotatable component 42 must have enough thickness for forming the ring grooves therein, thus causing an increase in weight. In addition, it is hard to insert the rotatable component 42 into the case 41 due to the frictional force of the "O" ring 46 which has to slide on the whole inner wall of the case 41. Also, it is easy to apply grease on only an outer surface of the rotatable component 42, but it is almost impossible to do the same on the inner wall of the case 41.

The present invention was developed taking the above problems into consideration and provides a light hinge device enabling an easy assembling operation.

SUMMARY OF THE INVENTION

In order to carry out the above object, the present invention provides a hinge device, having a case to be connected to a stationary component, a rotatable cylinder to be connected to a rotatable component and rotatably supported by the case, a high viscosity substance filled in a gap between the case and the rotatable cylinder and a coil spring mounted between an end wall of the case and the rotatable cylinder, comprising a non-circular coupling hole formed in the rotatable cylinder for receiving a connecting rod, an "O" ring inserted in a ring groove formed on an outer surface of the rotatable cylinder so as to enclose the high viscosity substance in the gap and another "O" ring inserted into a gap formed by the case and an inner end of the rotatable cylinder.

Since the connecting rod to be connected to a rotatable component is detachably connected to the rotatable cylinder, it is possible to connect a rotatable component to the rotatable cylinder after fastening the case to the stationary component.

Since, one of the "O" rings is inserted into the ring groove formed on the outer surface of the rotatable cylinder and another is inserted into the gap formed by the case and the chamfered end of the rotatable cylinder, the wall thickness of the rotatable cylinder can be reduced to be as thin as possible. The rotatable cylinder can be inserted easily into the case, because the second "O" ring does not slide on the inner wall of the case. Also, it is easy to apply a high viscosity substance on the inner wall of the case.

BRIEF DESCRIPTION OF THE DRAWINGS

FIG. 10 (*b*) shows an enlarged sectional view along line A—A in FIG. 10 (*a*).

FIG. 10 (*c*) shows an enlarged sectional view along line B—B in FIG. 10 (*a*).

FIG. 10 (*d*) shows an enlarged sectional view along line C—C in FIG. 10 (*a*).

FIG. 11 (*b*) shows an enlarged sectional view along line D—D in FIG. (*a*).

FIG. 11 (*c*) shows an enlarged sectional view along line E—E in FIG. 11 (*a*).

FIG. 11 (*d*) shows an enlarged sectional view along line F—F in FIG. 11 (*a*).

FIG. 11 (*e*) shows an enlarged sectional view along line G—G in FIG. 11 (*a*).

FIG. 11 (*f*) shows an enlarged sectional view along line H—H of FIG. 11 (*a*).

FIG. 11 (*g*) shows an enlarged sectional view along line J—J in FIG. 11 (*a*).

DETAILED DESCRIPTION OF THE PREFERRED EMBODIMENTS

Figure 1:
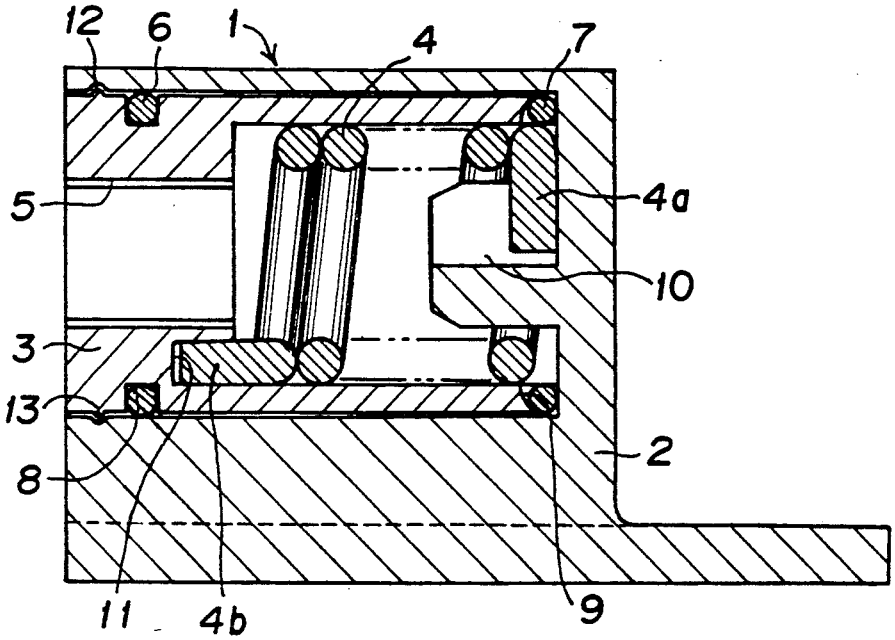
FIG. 1 shows a front sectional view of an embodiment according to the present invention.

Hereinafter, some embodiments according to the present invention will be described referring to the drawings.

Figure 2:
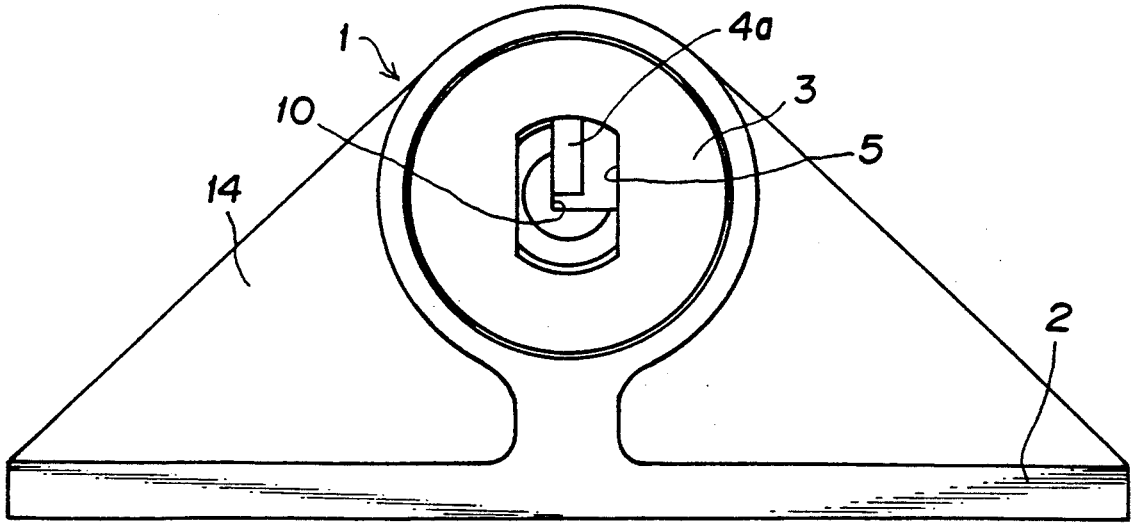
FIG. 2 shows a left side view.
Figure 3:
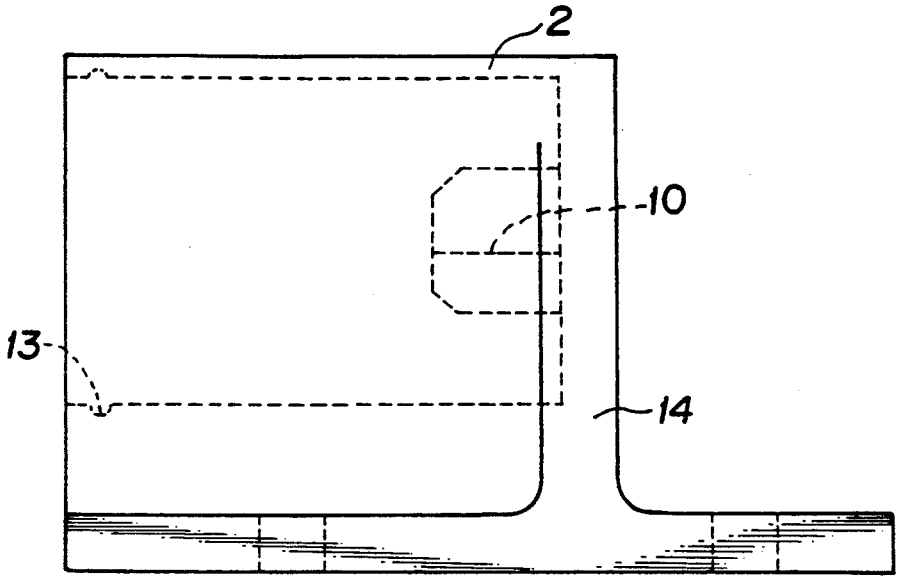
FIG. 3 shows a front view of a case.

In FIGS. 1 and 2, a hinge device 1 comprises a case 2 to be fixed on a rotatable component such as a stool or the like, a rotatable cylinder 3 to be connected to the rotatable component through a connecting rod to be described later, high viscosity grease filled in a gap between the case 2 and the rotatable cylinder 3 and a coil spring 4 mounted between the case 2 and the rotatable cylinder 3.

The rotatable cylinder 3 is provided with a non-circular bearing hole 5 for connecting the connecting rod. An "O" ring 6 is inserted into a ring groove formed on the outer surface of the bearing 5. Another "O" ring 7 is supported by the case 2 and the chamfered end of the rotatable cylinder 3.

Figure 4:
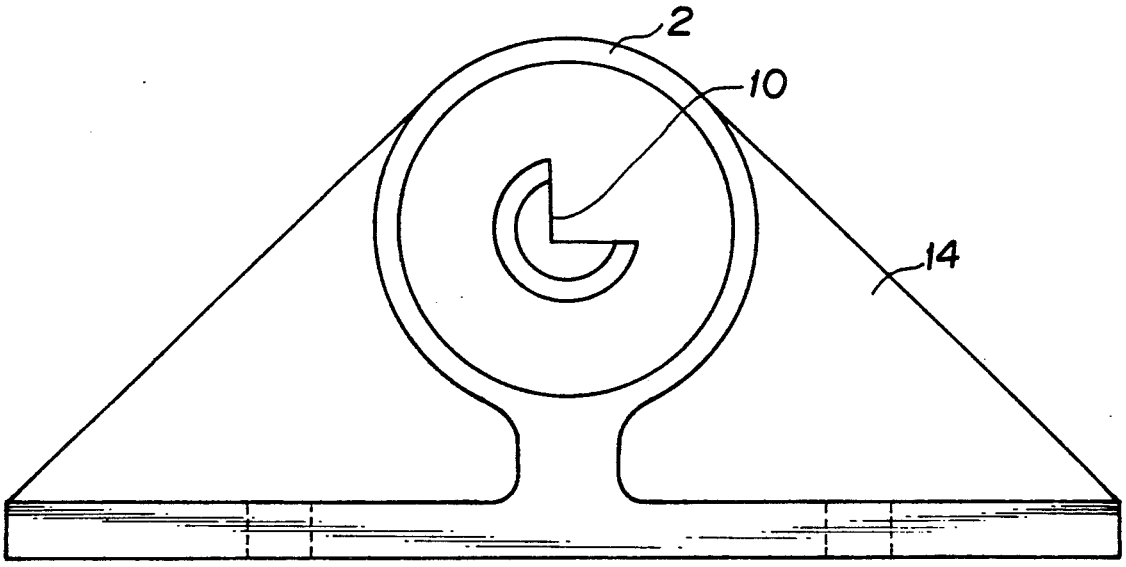
FIG. 4 shows a right side view.
Figure 5:
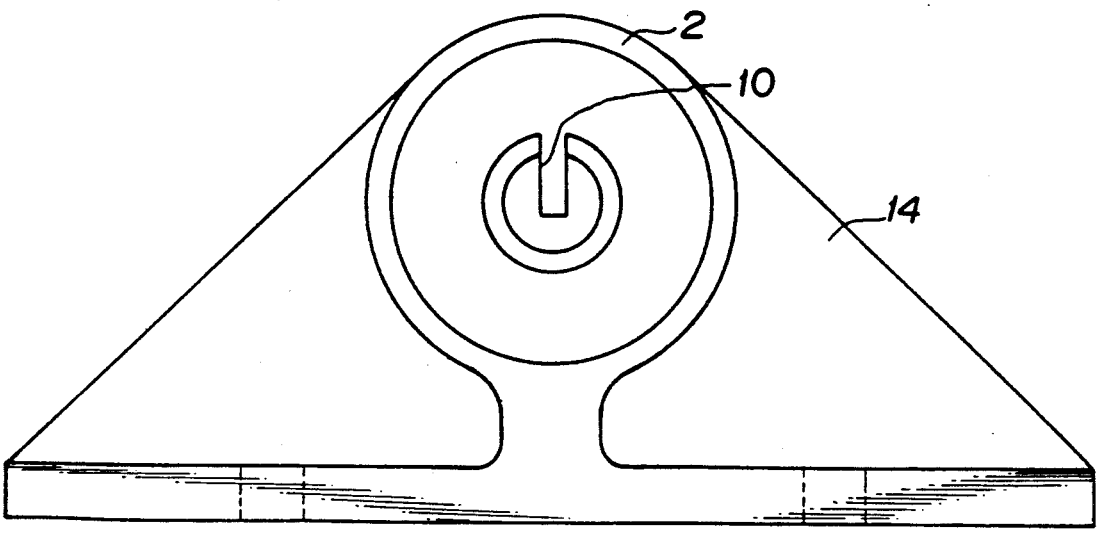
FIG. 5 shows a left side view of another variation of a case.
Figure 6:
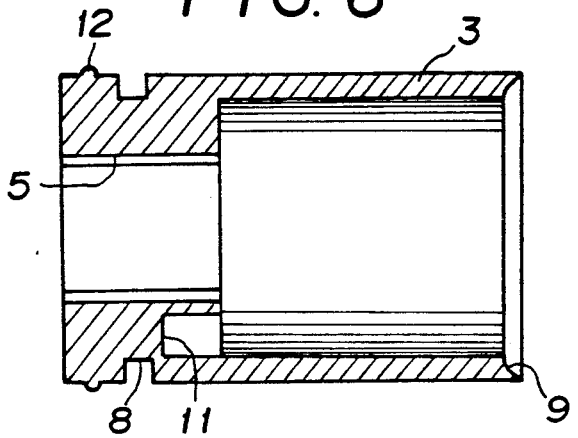
FIG. 6 shows a front sectional view of a rotatable cylinder.

A hook portion 4a of a coil spring 4 is inserted into a groove 10 of the case 2 and another hook portion 4b is inserted into a hole 11 of the rotatable cylinder 3. The groove 10 may be a quarter sector formed on a protruded shaft portion of the case 2 as shown in FIG. 4 or a groove as shown in FIG. 5. However, when the rotatable cylinder 3 is assembled into the case 2, an inserting operation of the hook portion 4a of coil spring 4 into the groove 10 must be done by groping for the groove. Then, the sector in FIG. 4 is more useful for the assembling work.

Figure 7:
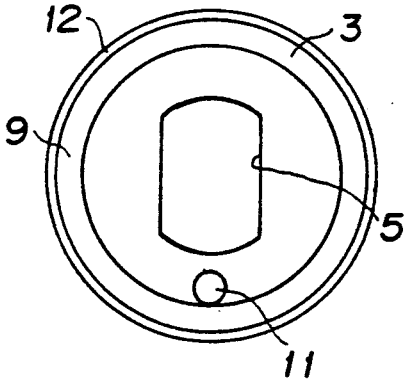
FIG. 7 shows a right side view of the rotatable cylinder.
Figure 8:
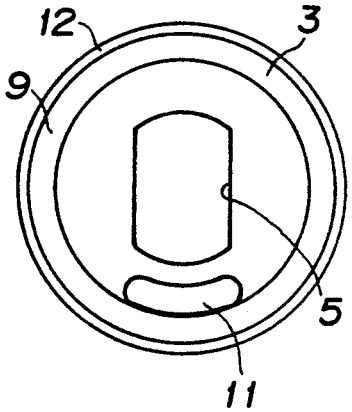
FIG. 8 shows a right side view of the rotatable cylinder.

The hole 11 of the rotatable cylinder 3 may be a simple round hole shown in FIG. 7 or an axial half round groove shown in FIG. 8. In case of the groove, an initial torque of the coil spring 4 is delayed a little. Accordingly, a rotatable component can be rotated fast until the hook portion 4b hits the groove end and then rotated slower.

In FIG. 1, numeral 12 indicates a ring shaped rib provided on the outer surface of the rotatable cylinder 3, which is inserted into a ring shaped groove 13 provided on the inner wall of the case 2 so that the rotatable cylinder 3 is retained in the case 2.

In FIGS. 2 to 5, numeral 14 indicates reinforcement ribs.

Figure 9:
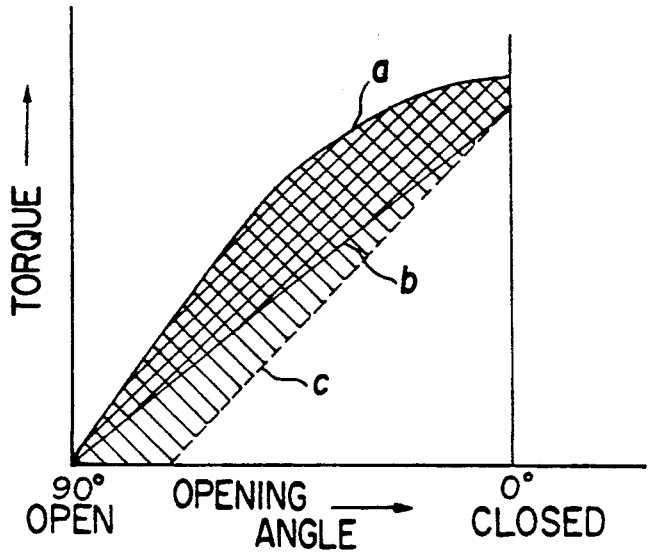
FIG. 9 shows a characteristic curve between an opening angle and rotational torque.

The case 2 is fixed on a stationary component and the rotatable cylinder 3 is connected to a rotatable component through a connecting rod. If the rotatable component is rotated, a rotational torque of the coil spring 4 (line "b" in FIG. 9) works in the opening direction in relation to a rotational moment due to the proper weight of the rotatable component (line a in FIG. 9) in addition to the friction of high viscosity grease and "O" rings 6 and 7. The shaded areas indicate a speed control range of the rotatable component. A broken line "c" in FIG. 9 shows a late friction in the case of groove 11 into which the hook portion 4b is inserted, wherein the spring constant is increased by reducing the number of coil windings.

Hereinafter, applied embodiments will be described referring to FIGS. 10 and 11.

Figure 10A:
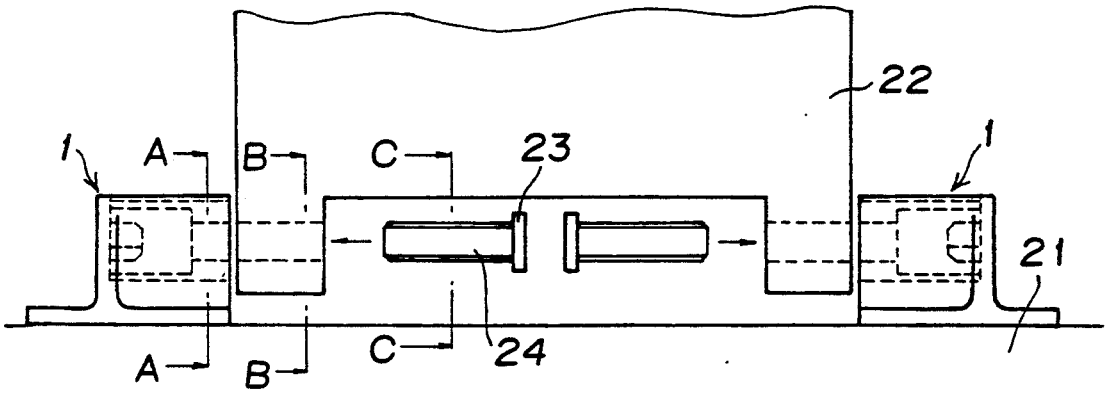
FIG. 10 (*a*) shows an applied hinge device according to the present invention.
Figure 10:
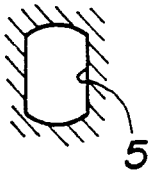
Figure 10:
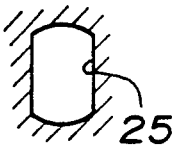
Figure 10:
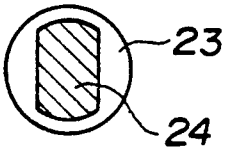

In FIG. 10 (*a*), a hinge device 1 according to the present invention is fixed on a stationary component 21 such as the main body of a piano and rotatable component 22, a sound board of piano in this case, is connected to the hinge device 1 through a connecting rod 23. Sectional view of the shaft portion 24 of the connecting rod 23 is of non-circular form as shown in FIG. 10 (*d*) as well as the non-circular hole 25 of the rotatable cylinder 22 as shown in FIG. 10 (*c*). The bearing hole 5 of the hinge device 1 is of non-circular form too as shown in FIG. 10 (*b*). Accordingly, when the shaft 24 of the connecting rod 23 is inserted into the hole 25 of the rotatable component 22 and the bearing hole 5 of the hinge device 1, a shock absorbing effect is obtained by the hinge device 1 on the both ends.

In this case, a pair of hinge devices are not always used, for example only one hinge device may be used on one side and a simple pivot system may be used on the other side. The connecting rod 23 may be retained by inserting a snap ring into a ring groove (not shown).

Figure 11A:
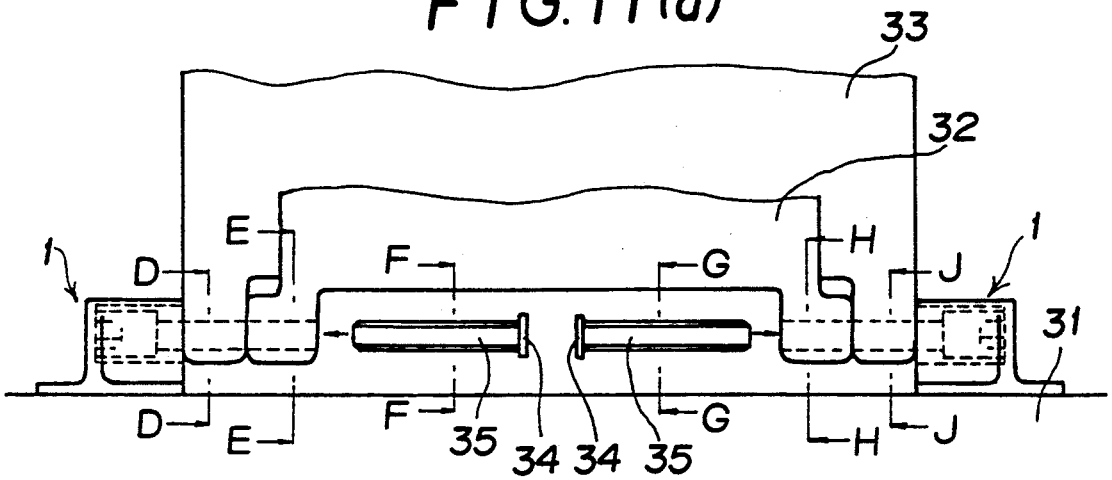
FIG. 11 (*a*) shows a front view of another hinge device according to the present invention.
Figure 11:
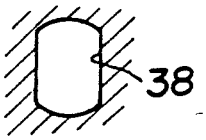
Figure 11:
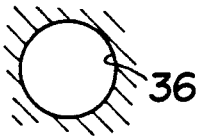
Figure 11:
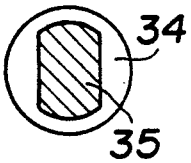
Figure 11:
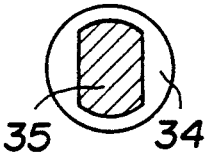
Figure 11:
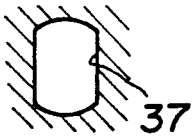
Figure 11:
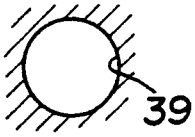
Figure 12:
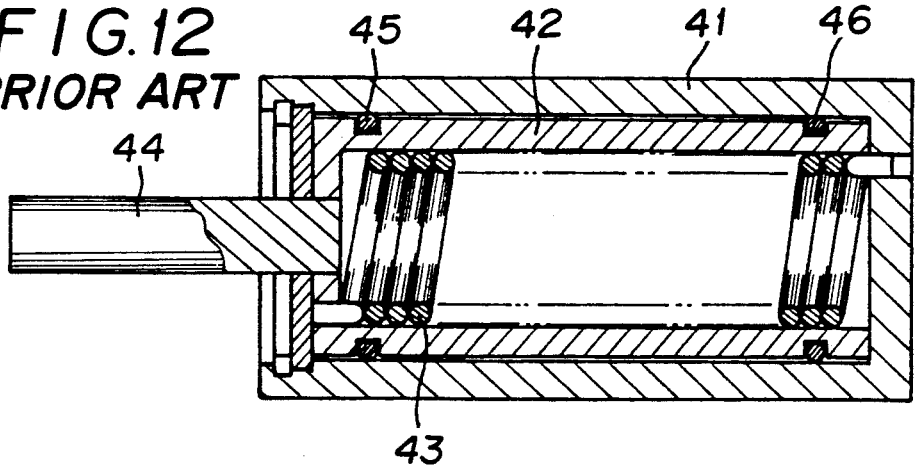
FIG. 12 PRIOR ART
FIG. 12 shows a front sectional view of a conventional hinge device.

In FIG. 11 (*a*), another embodiment according to the present invention is described. A hinge device is fixed on a stationary component 31, a ceramic portion of a stool in this case, and rotatable components, a stool 32 and a lid 33 in this case, are connected to the hinge device 1 through connecting rods 34. A shaft portion 35 of the connecting rod 34 is of non-circular form as shown in FIGS. 11 (*d*) and (*e*). A hole portion 36 on the left side of the stool 32 is a round hole. A hole portion 37 on the right side of the stool 32 is of non-circular form as shown in FIG. 11 (*f*). A hole portion 38 on the left side of the lid 33 is of non-circular form as shown in FIG. 11 (*b*) and a hole portion 39 on the right side is a round hole as shown in FIG. 11 (*g*).

In conclusion, the hinge device 1 is fixed on the ceramic portion 31, and the stool 32 and the lid 33 are connected to the bearing hole 5 of the hinge device 1 by inserting the connecting rod 34. Then, when the stool 32 is rotated, the hinge device 1 on the right side works as a shock absorber, and when the lid 33 is rotated, the hinge device 1 on the left side works as a shock absorber.

As aforementioned, since the connecting rod 23 (34) are detachably inserted into the bearing hole 5 of the rotatable cylinder 3, it is possible to mount the rotatable component after fixing the case 2 on the stationary component, resulting in improved assembly. Also, since the "O" ring 6 is inserted into the ring groove 8 provided on the outer surface of the bearing portion 5 of the rotatable cylinder 3 and another "O" ring 7 is inserted into a gap formed by the case 2 and the chamfered end 9 of the rotatable cylinder 3, the wall of the rotatable cylinder 3 can be reduced to be as thin as possible resulting in a reduction of weight and improved assembly of the rotatable cylinder 3 into the case 2.

In the above embodiments, elastic packings made of synthetic resins or rubber may be used in the place of the "O" rings.

According to the aforementioned embodiments, the connecting rod is detachably connected between the rotatable cylinder and the rotatable component. Therefore, the rotatable component can be connected to the rotatable cylinder on the stationary component side after fixing the case containing the rotatable cylinder to the rotatable component, resulting in improved assembly. Also, it is possible to integrally construct the case and the stationary component.

Also, the "O" ring 7 is secured in a gap formed by the case 2 and the chamfered end 9 of the rotatable cylinder 3. Therefore the wall of the rotatable cylinder 3 can be reduced to be as thin as possible and it is easy to insert the "O" ring 7 into the case 2. Also, it is easy to apply high viscosity grease on the inner wall of the case 2.

What is claimed is:

1. A hinge device having a case to be connected to one of a stationary component and a rotatable component, a rotatable cylinder to be connected to another of said stationary component and said rotatable component, and rotatably supported by said case, a high viscosity substance filled in a gap between said case and said rotatable cylinder, and a coil spring mounted between an end wall of said case and said rotatable cylinder, comprising:

a non-circular bearing formed coaxially on said rotatable cylinder into which a connecting rod is inserted;

an elastic "O" ring inserted into a gap formed by said end wall of said case and a chamfered end of said rotatable cylinder so as to seal said high viscosity substance;

an axial hole formed on said non-circular bearing into which a hook of said coil spring is inserted; and a groove formed on a shaft portion protruding from said end wall of said case into which another hook of said coil spring is inserted.

2. A hinge device according to claim 1 wherein the groove is a quarter sector cut on said shaft portion protruding from said end wall of said case.

3. A hinge device according to claim 1 wherein the connecting rod comprises a non-circular outer surface inserted detachably into said non-circular bearing and having a sufficient length to connect at least one component.

4. A hinge device according to claim 1, wherein a hole into which a hook of said coil spring is inserted is shaped in a longitudinal arc-like form.

* * * * *